US006530852B2

(12) United States Patent
Rios

(10) Patent No.: US 6,530,852 B2
(45) **Date of Patent: *Mar. 11, 2003**

(54) BAT STRUCTURE

(76) Inventor: Jaime Rios, 754 Cardinal Dr., Livermore, CA (US) 94550

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/520,018

(22) Filed: Mar. 7, 2000

(65) Prior Publication Data

US 2002/0061796 A1 May 23, 2002

(51) Int. Cl.[7] ..... A63B 59/06
(52) U.S. Cl. ..... 473/566
(58) Field of Search ..... 473/457, 564–568, 473/519, 520, 518, 552, FOR 169, FOR 170; 280/602; 43/23

(56) References Cited

U.S. PATENT DOCUMENTS

| | | | | | |
|---|---|---|---|---|---|
| 1,603,904 | A | | 10/1926 | Cohn | |
| 1,665,195 | A | | 4/1928 | Cohn | |
| 3,224,769 | A | * | 12/1965 | Nickell | 473/567 |
| 3,578,801 | A | * | 5/1971 | Piazza | 473/520 |
| 3,801,098 | A | | 4/1974 | Gildemeister | |
| 4,056,267 | A | | 11/1977 | Krieger | |
| 4,105,205 | A | * | 8/1978 | Theodores et al. | 473/552 |
| 4,221,400 | A | * | 9/1980 | Powers | 280/602 |
| 4,274,631 | A | * | 6/1981 | Hayazaki | 473/457 |
| 4,738,046 | A | * | 4/1988 | Fraylick et al. | 43/23 |
| 4,951,948 | A | | 8/1990 | Peng | |
| 5,165,686 | A | | 11/1992 | Morgan | |
| 5,179,255 | A | | 1/1993 | Yeh | |
| 5,219,164 | A | | 6/1993 | Peng | |
| 6,113,508 | A | * | 9/2000 | Locarno et al. | 473/318 |

FOREIGN PATENT DOCUMENTS

| | | | | |
|---|---|---|---|---|
| RU | 1088733 | * | 4/1984 | 473/FOR 169 |

* cited by examiner

*Primary Examiner*—Mark S. Graham
(74) *Attorney, Agent, or Firm*—Theodore J. Bielen, Jr.

(57) ABSTRACT

A structure for a sport bat utilizing a shell having an elongated shape along a certain dimension. The shell includes a gripping surface for the user and a contact surface for propelling a ball or similar object of play. The shell further possesses a wall which forms a chamber. A first member contacts the first end portion of the elongated shell, while a second member contacts the second end portion of the elongated shell. A connector links the first and second members to one another within the chamber. A tensioning device adjusts the tension on the connector and generates a pressure on the shell at its wall along the axis or dimension of elongation of the shell.

4 Claims, 2 Drawing Sheets

BAT STRUCTURE

BACKGROUND OF THE INVENTION

The present invention relates to a novel and useful structure for a sport bat.

Bats are typically used for hitting balls and other objects in sports activities. For example, in a baseball game a bat is used to hit a baseball thrown by a pitcher. Batters employing such bats require customized bats according to length, and weight, as well as to the shape. That is to say the dimensions between the gripping handle of the bat and the barrel of the bat used to contact the ball is altered greatly.

Many bats have been devised to reduce the danger of injury caused by a broken bat, typically manufactured of wood. For example, U.S. Pat. Nos. 1,603,904, 1,665,195, and 5,165,686 describe bats that have internal reinforcing rods along the length to strengthen the structure of a patent.

U.S. Pat. Nos. 3,801,098, 4,056,267, and 5,219,164 describe baseball bats having a combination of reinforcing rods and foam filling material inside the shell of the bat to absorb shock.

U.S. Pat. No. 4,951,948 illustrates a shock-absorbing bat in which an elastic connector, in the form of a spring within the chamber of the bat, is supported by a multiplicity of retainers.

U.S. Pat. No. 5,179,255 describes a novelty bat which utilizes a central spring that extends from one end of the bat chamber to the other for the purpose of producing a sound.

A bat structure which allows the user to adjust the compression or tension of the wall of the bat would be a notable advance in the sporting field.

BRIEF SUMMARY OF THE INVENTION

The present invention relates to a novel and useful bat structure.

The bat structure of the present invention utilizes a shell which is elongated along a dimension such as an axis. The shell has a first end portion which includes a gripping surface or handle. The shell also includes a second end portion opposite the first end portion and includes a contact surface, such as the barrel of the bat. Both surfaces comprise outer terminations of a wall portion, which forms an inner chamber of the shell. The wall portion of the chamber may be formed of metallic, composite, or other material normally used in a bat structure.

A first member is also found in the structure of the present invention and is employed to contact the first end portion of the elongated shell. Such first member may take the form of an enlargement at the end of the handle of the bat, commonly referred to as the knob.

The present invention also includes a second member which contacts the second end portion of the elongated shell, remotely from the handle of the bat, and immediately adjacent to the barrel of the bat. The second member may take the form of a cap having a profile to match the external contour of the second portion of the bat shell. It should be noted that both the first member and the second member may be affixed to the wall portion of the shell or be separable therefrom.

In any case, connecting means is employed for linking the first and second members together. The connecting means lies within the chamber of the shell and may take the form of a connecting rod. In one embodiment, the connecting means fixes to the second member and engages the first member directly or indirectly.

Means is also included for adjusting the tension on the connecting means to generate a pressure on the shell wall along the dimension of elongation of the shell. Such means for adjusting the tension on the rod includes a threaded portion on the rod which threadingly engages in a threaded element such as a nut or internally threaded bushing. The nut or bushing includes an end portion in the form of a fitting that may be engaged by a wrench or other tool to tighten or loosen the threaded interconnection between the rod and the bushing. In this regard, the second member may include a recess to permit the fitting to lie below the outer surface of the wall portion of the shell.

It may be apparent that a novel and useful bat structure has been hereinbefore described.

It is therefore an object of the present invention to provide a bat structure usable in a sporting event in which the rigidity or stiffness of the bat is adjustable.

Another object of the present invention is to provide a bat structure for use in sporting events in which energy loss is minimized upon impact with an article of play such as a baseball or softball.

Another object of the present invention is to provide a bat structure for sporting game in which the stiffness of the bat is adjusted by placing the wall portion of the bat in compression through an adjustment mechanism.

Yet another object of the present invention is to provide a bat structure for a sporting game which is capable of propelling a ball a further distance than a conventional bat.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove-delineated drawings.

Figure 1:
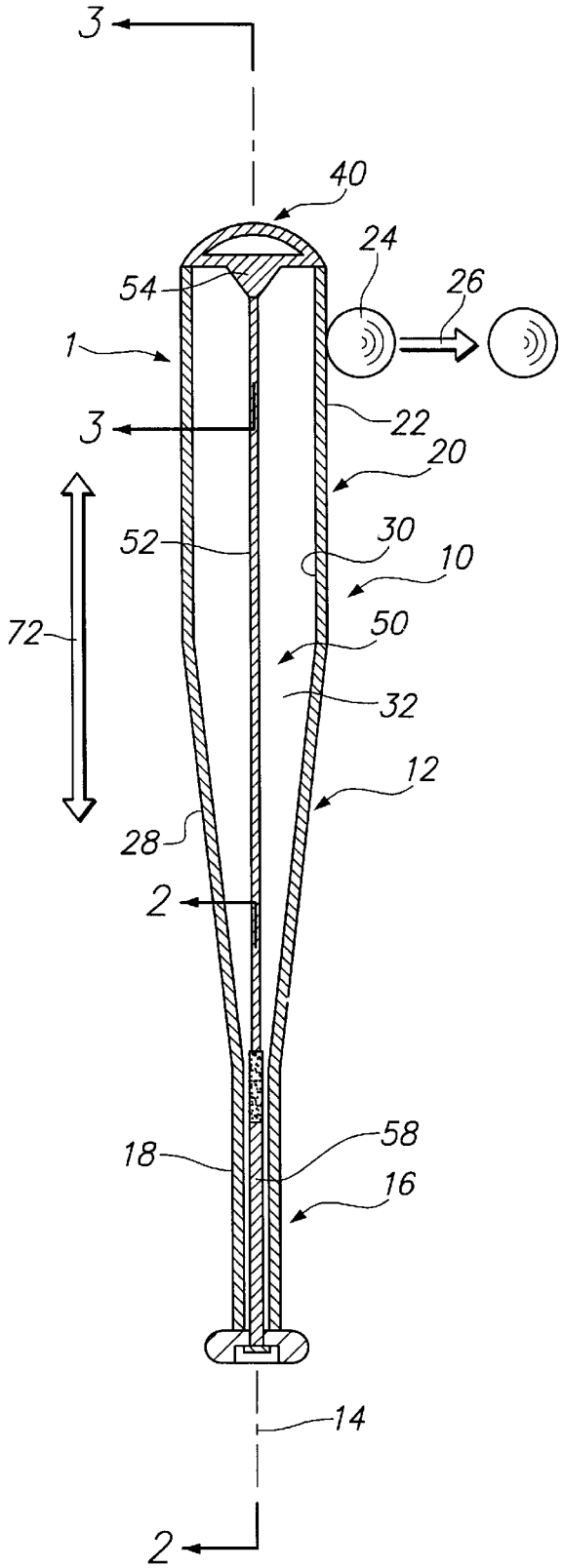
FIG. 1 is a sectional view of the bat structure of the present invention in use with a ball.

The invention as a whole is shown in the drawings by reference character 10. Bat structure 10, FIG. 1, includes as one of its elements, a shell 12. Shell 12 is elongated along axis 14. Shell 12 as depicted in FIG. 1, is constructed of a metallic material. However, shell 12 may be fashioned from composite material, plastic material, wood, and the like. Generally, shell 12 includes a first end portion 16 having a gripping surface 18 generally held by a person swinging bat structure 12. Second end portion 20 is also depicted in FIG. 1 and includes a contact surface 22 which is intended to meet ball 24 to propel the same according to directional arrow 26. It should be noted that first end portion 16 is narrower than second end portion 20 of bat structure 12, as is found in the conventional design. Shell 12 is formed with a wall 28 which terminates outwardly in gripping surface 18 and contact surface 22. Inner surface 30 of wall 28 lies along a chamber 32.

Figure 2:
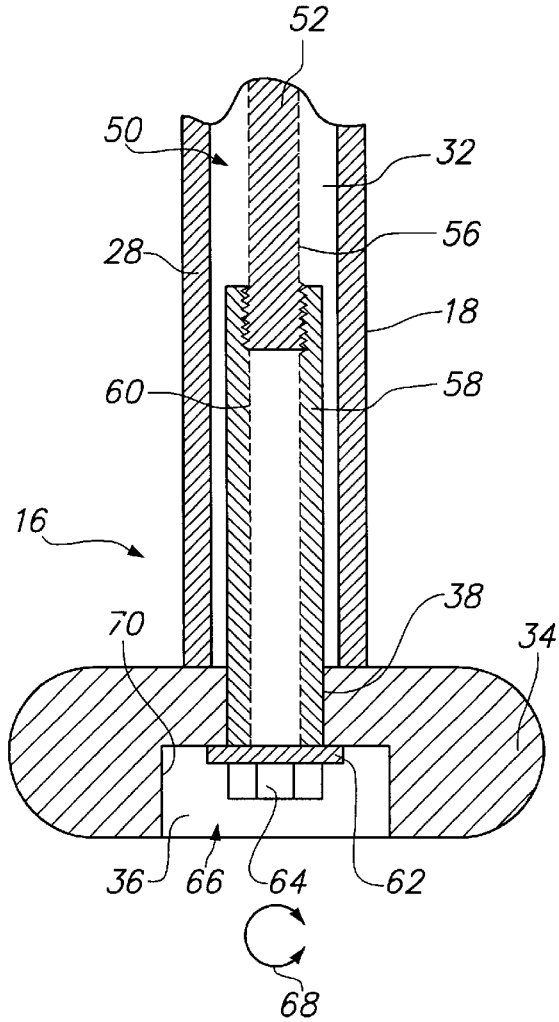
FIG. 2 is a sectional view depicting an enlarged detail of the handle section of the bat, taken along line 2—2 of FIG. 1.

Turning to FIG. 2, it may be observed that first end portion 16 is depicted in detail. First end portion terminates in first member 34 which is in the shape of a knob. First member 34 may be securely fastened to wall 28 or be separable. Knob 34 includes a recess 36, the purpose of which will be discussed hereinafter. Knob 34 also includes a passageway 38 which leads from recess 36 to chamber 32 of shell 12.

Figure 3:
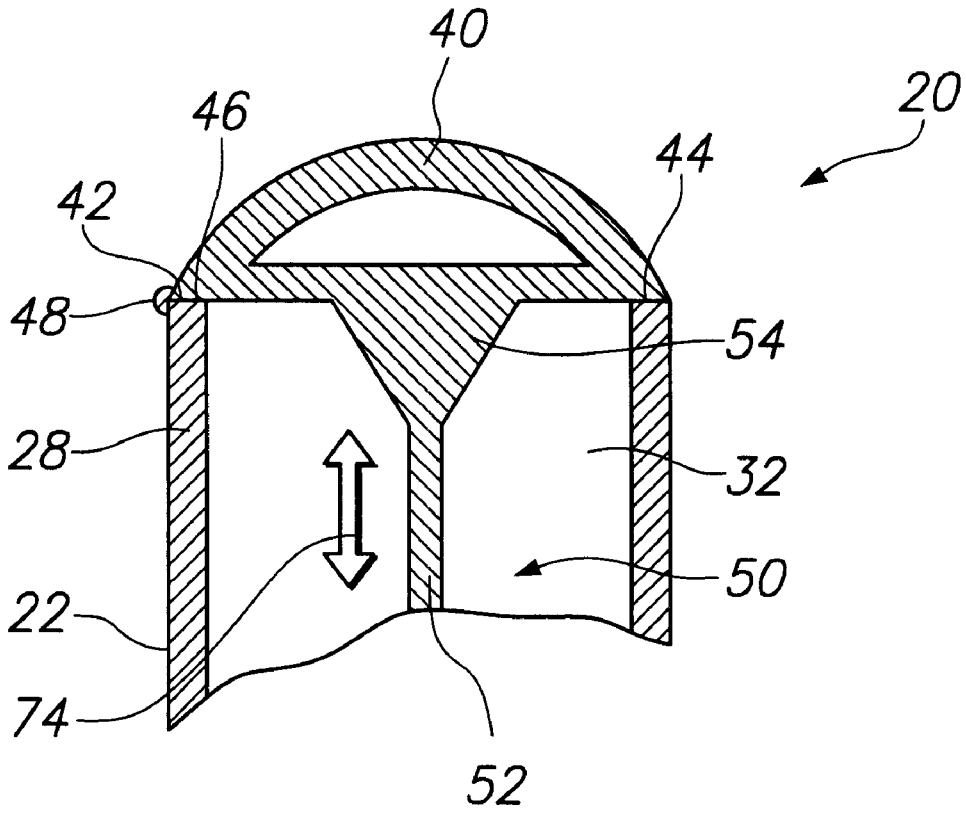
FIG. 3 is an enlarged detail of the barrel end of the bat structure of the present invention taken along line 3—3 of FIG. 1.

With reference now to FIG. 3, second end portion 20 is depicted in detail. Second end portion 20 includes a cap 40 which fits on the upper edge 42 of wall 28. Cap 42 may be loosely placed on edge 42, in which case edge 42 may be formed with a bevel 44. FIG. 3 also shows an alternate mating of cap 42 to wall 28 in which edge 42 includes a straight surface 46 and a weld seam 48. Both embodiments are depicted in FIG. 3 on either side of the sectional view of second end portion 20 and cap 40.

Connecting means 50 is also illustrated in the drawings. Connection means 50 includes a rod 52 which lies within chamber 32. Rod 52 is connected to a dependent conical member 54 which is constructed as a portion of cap 40. Rod 52 possesses a threaded portion 56 which extends through chamber 52 to the first portion 16 of bat structure 10. Threaded portion 56 of rod 52 is depicted in FIG. 2 as partially in phantom for the sake of simplicity. Threaded portion 56 connects to threaded bushing 58 which includes an internally threaded portion 60, again shown partially in phantom. Threaded bushing 58 is connected to a plate 62 which is itself fixed to a fitting 64. Fitting 64 permits one to use a wrench to turn threaded bushing 58. Thus, rod 52, threaded bushing 58, and plate 62 link first member or cap 40 to second member or knob 34.

Means 66 is also depicted in the drawings for adjusting the tension on connecting means 50. Such means may take the form of a threaded engagement between threaded portion 56 or rod 52 and threaded portion 60 of threaded bushing 58. In addition, fitting 64 permits the relative turning between these two elements according to directional arrow 68. Such turning adjusts the pressure of plate 62 on surface 70 of knob 34 within recess 36. Directional arrow 72, FIG. 1, and directional arrow 74, FIG. 3, indicates such tensioning. Movement of rod 52 toward threaded bushing 58 will, of course, compress wall 28 of shell 12 between knob 34 and cap 40. This movement increases the stiffness of bat structure 10. Movement of rod 52 and threaded bushing 58 in an opposite direction will decrease the tension in bat 10.

In operation, the user tightens or loosens threaded bushing 58 by placing a wrench or other suitable tool on fitting 64 to turn the same. When the proper tension on bat structure 10 is attained, the user then employs bat structure 10 to hit or propel ball 24, as shown in FIG. 1.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A ball bat structure, comprising:

a. a metallic, and elongated hollow shell having a dimension of elongation, said metallic, elongated hollow shell having a first end portion including a gripping surface, and a second end portion including a contact surface, said metallic, elongated, hollow shell further including a contiguous wall forming a chamber;

b. a first member, said first member directly contacting said first end portion of said metallic, elongated, hollow shell;

c. a second member, said second member directly contacting s aid second end portion of said metallic, elongated, hollow shell, said second member comprising a cap overlying said chamber at said second end portion of said metallic, elongated, hollow shell, said cap being positioned against said wall of said metallic, elongated, hollow shell;

d. connecting means for linking said first and second members, said connecting means lying within said chamber of said metallic, elongated, hollow shell, said connecting means positioned within said chamber to be free of contact with said metallic, elongated, hollow shell;

e. means for adjusting the tension on said connecting means to generate pressure on said metallic, elongated, hollow shell wall along said dimension of elongation of said metallic, elongated, hollow shell.

2. The structure of claim 1 in which said connecting means comprises a rod, and said means for adjusting the tension on said rod includes a threaded portion on said rod, a threaded element threadingly engaging said threaded portion of said rod, said threaded element engaging said first member.

3. The structure of claim 2 in which said first member includes a recess, at least a portion of said threaded element lying within said recess.

4. The structure of claim 3 in which said threaded element includes an end fitting, said end fitting lying within said recess of said first member.

* * * * *